US005271101A

United States Patent [19]

Speth et al.

[11] Patent Number: 5,271,101

[45] Date of Patent: Dec. 21, 1993

[54] CYCLING SHORTS WITH ANATOMICAL SEAT PAD

[75] Inventors: Rachel Speth; Peter Kallen; Chris Helmsworth, all of Portland, Oreg.

[73] Assignee: Nike, Inc., Beaverton, Oreg.

[21] Appl. No.: 946,619

[22] Filed: Sep. 18, 1992

[51] Int. Cl.[5] ..... A41D 1/06

[52] U.S. Cl. ..... 2/228; 2/227; 2/214; 2/238; 2/267

[58] Field of Search ..... 2/228, 227, 214, 238, 2/243 A, 243 B, 243 R, 267, 268, 73, 78 R, 78 A, 78 B, 53, 54; 450/95, 96, 97, 98, 99, 100, 101, 102, 103, 104, 105; 69/2

[56] References Cited

U.S. PATENT DOCUMENTS 2,318,199 5/1943 Clements .
4,805,243 2/1989 Gibbens et al. ..... 2/238
4,945,571 8/1990 Calvert .
4,961,233 10/1990 Black ..... 2/238
4,961,233 10/1990 Black .
5,038,408 8/1991 DeBaene .
5,068,920 12/1991 Bray .

OTHER PUBLICATIONS

Bike Nashbar Catalog, Holiday 1991, pp. 12 and 13.
Bike Nashbar Catalog, Summer 1992, pp. 2 and 3.
Performance Bicycle, Summer 1992, pp. 2, 3 and 4.
Colorado Cyclist, Summer 1992, pp. 55 and 56.

*Primary Examiner*—Clifford D. Crowder
*Assistant Examiner*—Gloria Hale
*Attorney, Agent, or Firm*—Banner, Birch, McKie & Beckett

[57] ABSTRACT

Cycling shorts which provide a correct anatomical fit are disclosed. The shorts include a padded seat liner having a plurality of embossed break lines which are specifically positioned such that the liner conforms to the anatomical profile of a cyclist positioned in a riding position on a bicycle. A preferred embodiment of the seat liner has longitudinal, oblique and generally transverse arcuate break lines.

27 Claims, 3 Drawing Sheets

CYCLING SHORTS WITH ANATOMICAL SEAT PAD

TECHNICAL FIELD

The present invention relates to cycling shorts, and more particularly, to cycling shorts having a seat pad designed to conform to the anatomical figure of the cyclist. The seat pad preferably has a three-layer construction including a plurality of specifically positioned embossed lines.

BACKGROUND OF THE INVENTION

As a competitive sport, a recreational activity, or as a means for daily exercise, the popularity of cycling is dramatically increasing. With this increase in popularity, there is also a heightened concern for cycling safety, as evidenced by many of the new bicycle helmet laws, and an increased demand for comfortable and effective cycling apparel such as shoes, gloves and shorts. For example, cycling shoes are specifically designed to eliminate pressure points on the foot which occur during the upstroke of the bicycle pedal, to be lightweight, yet also to be rigid enough to endure the repetitive motion of cycling and protect the foot. Cycling gloves are usually worn to provide padded protection against the shocks and impacts transmitted through the handlebars when riding, to obtain a more secure hold on the handlebars, and to prevent the formation of blisters on the hands. Similarly, cycling shorts are provided with padding to absorb the shocks and vibrations transmitted through the saddle of the bicycle. Cycling shorts are also manufactured to wick moisture away from the body, to allow freedom of movement and to reduce chafing.

Cycling shorts generally have a four, six or eight panel construction, elastic ribbing around the bottom of the leg openings and the waist, and additional padding disposed in the buttocks and crotch regions termed a "chamois." The chamois is formed from various layers and materials which are stitched or laminated together to provide maximum protection to the cyclist. For example, the Ultimate Short cycling shorts made by Bike Nashbar of Youngstown, Ohio have a chamois liner including layers of Ultrasuede TM, polyurethane foam, and a polyurethane outer layer. Ultrasuede TM is a synthetic suede material manufactured by DuPont of Wilmington, Del. Other cycling shorts made by Nashbar have a two-ply chamois and include layers of polyurethane foam, terry cloth, or fleece. The Nike "7+1" cycling shorts manufactured by Nike, Inc. of Beaverton, Oreg. feature an eight panel shorts construction and a three-ply chamois which has a zig-zag baseball stitching design. The chamois in both the Bike Nashbar and prior Nike cycling shorts is cut to fit between the legs of the cyclist. However, the stiffness of the multiply construction is not conductive to providing a comfortable anatomically conforming fit.

To overcome this disadvantage, the cycling shorts disclosed in U.S. Pat. No. 4,961,233 to Black have a heat formed chamois made from a laminate of Ultrasuede TM and a knitted polyester fleece which are bonded together by an adhesive. The laminate is first heated to a temperature between the softening point and the melting point. While the laminate is at this elevated temperature, it is molded between shaped dies which correspond to the desired anatomical shape. When cooled, the molded chamois is cut from the fabric piece and sewn into the cycling shorts. Thus, an anatomical conforming chamois is achieved for the one position for which the chamois is molded. When the cyclist moves to other positions, however, the excess material still presents a problem and a less than conforming fit is obtained. The heat molding process utilized to obtain the shaped chamois also requires additional expense, labor and time for manufacturing. Therefore, a seat pad is still needed which can be economically made to provide an anatomically conforming fit for the various positions of the cyclist.

SUMMARY OF THE INVENTION

The present invention provides cycling shorts which are simple and inexpensive to manufacture, and which also provide a correct anatomical fit for better comfort to a cyclist. The cycling shorts of the present invention include a body portion and a pants liner that is attached to the inside surface of the body portion. The liner includes a seat pad and a plurality of embossed break lines specifically positioned such that the liner conforms to the anatomical profile of the cyclist positioned in a riding position on a bicycle.

The body portion of the shorts has a waist opening and two leg openings that enable a wearer to insert a leg through each leg opening and to pull the shorts upwards into a wearing position. The pants liner covers the buttocks region, the perineal region, and extends upwards to the lower front pelvic region of the wearer when the shorts are being worn. The linear is attached to the cycling shorts by either stitching or laminating the liner to the inside surface of the body portion. The plurality of embossed break lines on the liner include generally longitudinally disposed break lines extending through the perineal covering region such that the liner bends along the longitudinal break lines and better fits between the legs of the wearer. The liner also has generally transverse arcuate break lines disposed in the lower pelvic covering region such that the liner also bends along these break lines and more effectively wraps around the lower pelvic region of the wearer from front to back.

Accordingly, the present invention therefore provides cycling shorts which allow a comfortable, anatomical fit for virtually any position of the cyclist without the expense and labor associated with a shaped heat molding die.

BRIEF DESCRIPTION OF THE DRAWINGS

The novel features of the present invention are set out with particularity in the appended claims, but the invention will be understood more fully and clearly from the following detailed description of the invention as set forth in the accompanying drawings, in which:

DESCRIPTION OF A PREFERRED EMBODIMENT

Figure 1:
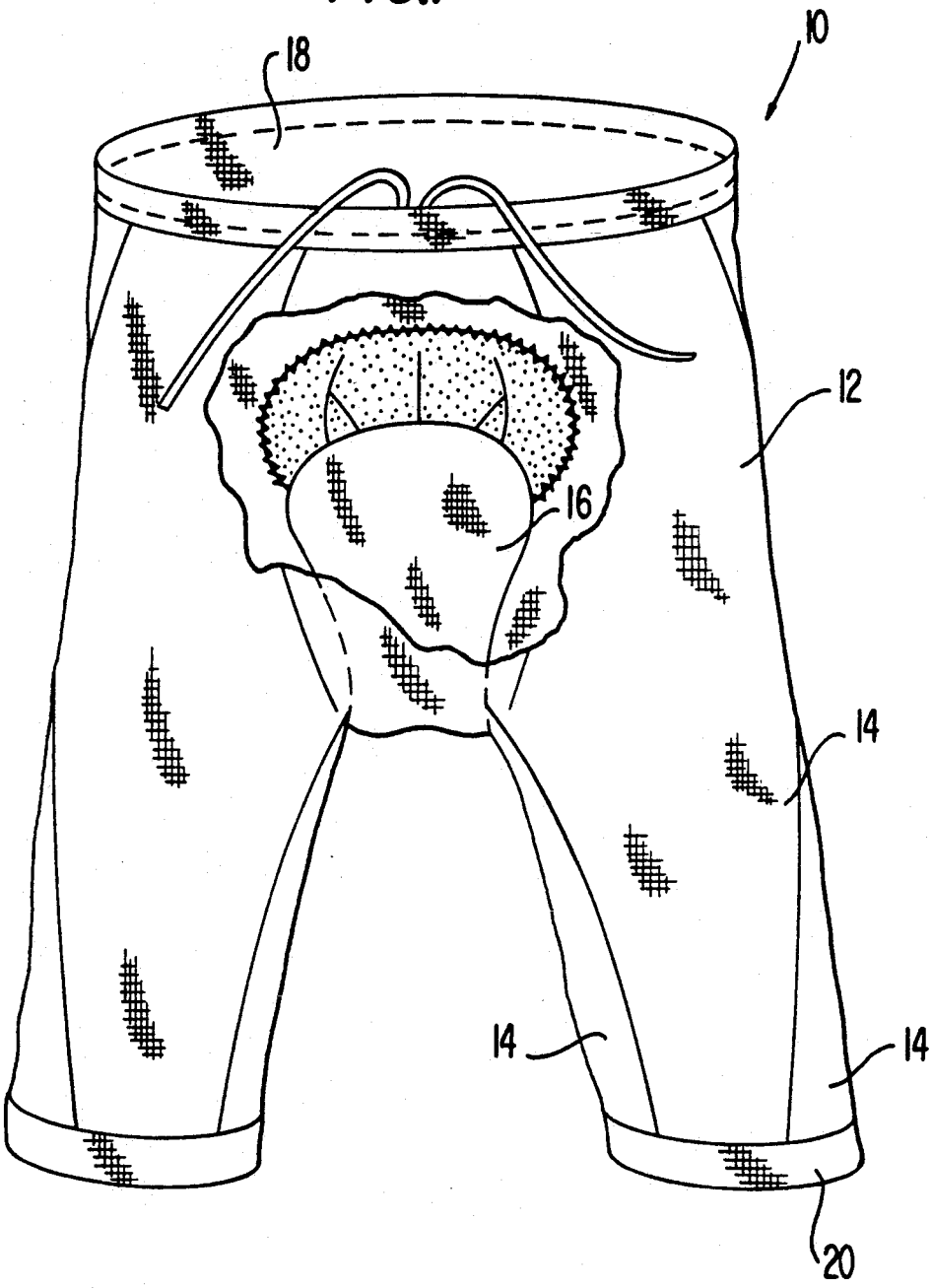
FIG. 1 is a front perspective view of the cycling shorts of the present invention with a breakaway portion showing the interior pants liner.
Figure 3:
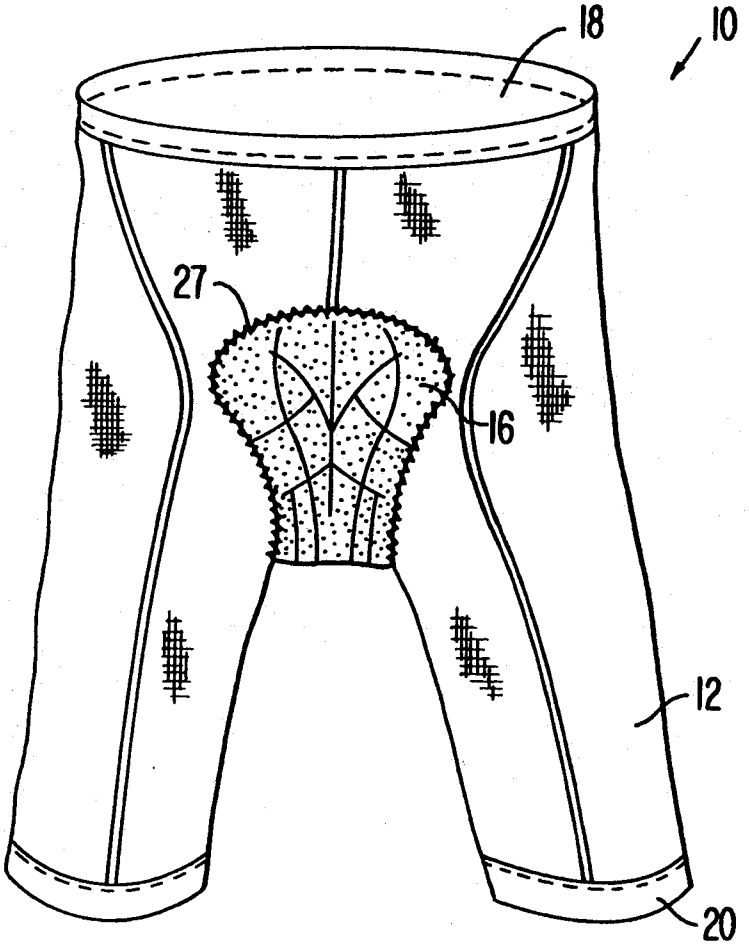
FIG. 3 is a rear perspective view of the cycling shorts shown in FIG. 1 when turned inside-out.
Figure 2:
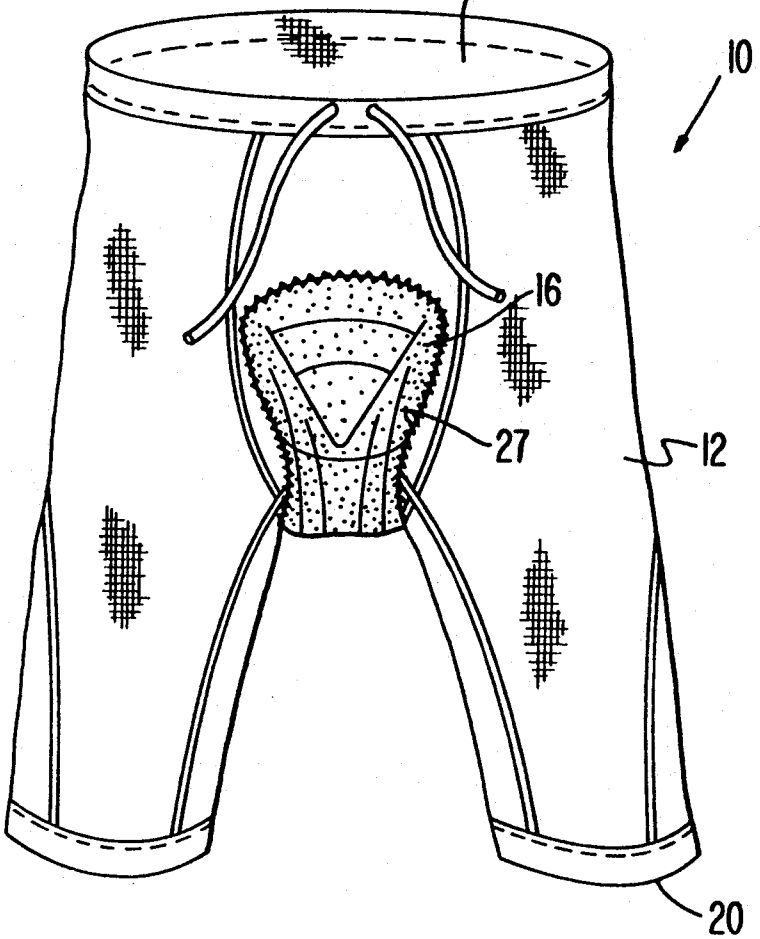
FIG. 2 is a front perspective view of the cycling shorts shown in FIG. 1 when turned inside-out.

Referring to FIGS. 1-3, a pair of cycling shorts according to the present invention is designated generally by the reference numeral 10. Cycling shorts 10 include a body portion 12 comprised of a plurality of separate panels 14 and an anatomical seat pad 16. A drawstring elastic waist opening 18 is provided to ensure a proper fit for the cyclist and elasticized leg openings 20 are provided to help prevent the legs from riding upwards while cycling. A 1¼" gripper elastic forms the bottom leg hem in a preferred embodiment. Body portion 12 is preferably constructed from seven individual panels 14 that are made from a nylon and spandex blend having four way stretch to provide a comfortable and conforming fit. In a preferred embodiment of the invention, a 7.5 ounce fabric is used made from 20% DuPont Lycra TM and 80% polyester.

Figure 4:
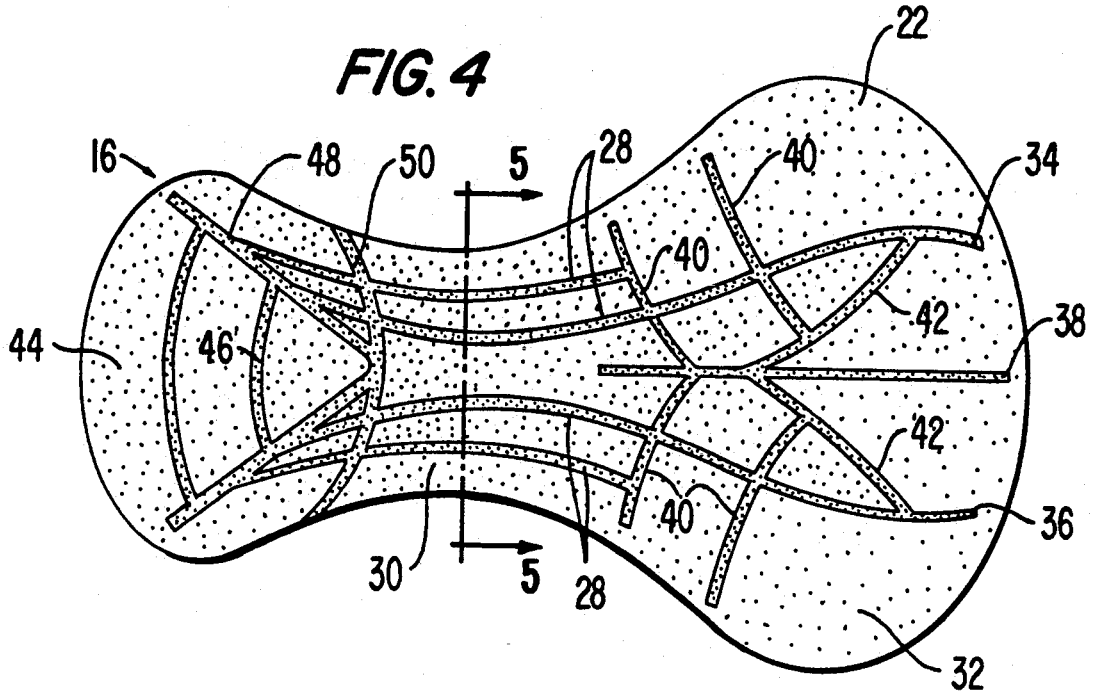
FIG. 4 is a top plan view of the pants liner of the cycling shorts shown in FIG. 1.
Figure 5:
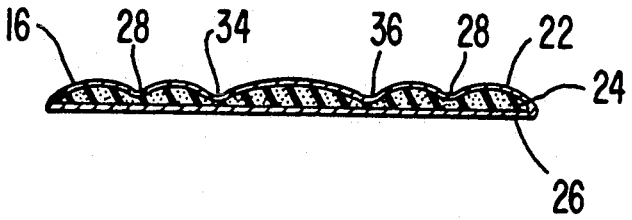
FIG. 5 is cross section of the pants liner taken along the line 5—5 shown in FIG. 4.

A preferred embodiment of the anatomical seat pad 16 includes a three-ply construction. Referring also to FIGS. 4 and 5, seat pad 16 is shown to have a top covering layer 22, a middle cushioning layer 24 and a backing layer 26. These layers 22, 24, 26 are adhered together in a conventional manner, and then ultimately attached to the body portion 12 of the cycling shorts by attaching means 27. The seat pad 16 is attached to body portion 12 by stitching it to the inside surface thereof or, preferably, by being laminated directly to the inside surface of the material. In a preferred embodiment of the present invention, top covering layer 22 is made from Suedemark TM, a synthetic suede material made of a polyester/nylon blend and manufactured by Clarino of Japan. Suedemark TM provides a soft blend that requires no special treatment and which dries quickly. The middle cushioning layer 24 is preferably constructed from a four millimeter thick polyurethane foam pad, preferably a high density open cell foam, to provide padded protection to the cyclist and to absorb the vibration and shocks from the road surface. Other cushioning pads such a closed cell foam or the like could of course also be used. The backing layer 26 is preferably made from a nylon tricot in order to allow the seat pad to move with the cyclist and thereby reduce chafing. The seat pad 16 is laminated to the inside surface of body portion 12 with the Suedemark TM side facing toward the cyclist using conventional lamination techniques. As generally shown in FIGS. 1-3, the seat pad 16 covers the buttocks region, the perineal region between the legs and the lower pelvic region of the cyclist when the cycling shorts are being worn.

The seat pad 16 also includes a plurality of embossed break lines disposed in specific positions to represent the pressure crease points of the seat pad when the cyclist is in both a cycling position and as he moves to other various positions. Accordingly, since the embossed break lines are adaptable to different positions, they prevent the bunching of excess material which occurs when a shaped, heat molded pad is utilized. These embossed break lines are formed by heat molding seat pad 16 in a flat position, which is more cost efficient and requires less time and labor than the shaped molding process of the prior art. As shown in FIGS. 4 and 5, the embossed break lines are also formed without utilizing stiching or sewn seams which can cause abrasion to the cyclist. As best illustrated in FIG. 4, seat pad 16 includes a plurality of generally longitudinal break lines 28 extending through the perineal covering region 30 in the middle of the seat pad. Longitudinal break lines 28 allow the seat pad 16 to bend along these lines and create a narrow tunneling effect which allows seat pad 16 to more readily fit between the legs of the cyclist and thus provide a more comfortable fit. Two of these longitudinal break lines include portions 34, 36 that also extend rearward through a buttocks covering region 32 of seat pad 16 in a generally longitudinal direction. These rearward longitudinal break line portions 34, 36 are separated by a further longitudinal break line 38 extending along the longitudinal center axis of seat pad 16 through only the buttocks covering region 32. A plurality of oblique, curving break lines 40 are also provided in the buttocks covering region 32. Oblique break lines 40 intersect longitudinal break line portions 34, 36 and terminate either at center break line 38 or at further oblique curving break lines 42 which connects center break line 38 with one of the rearward longitudinal break line portion 34, 36. Oblique curving break lines 42 curve conversely to oblique curving break lines 40. The oblique break lines function as a hinge by providing a point of alleviation to the longitudinal break lines and thereby improve the ability of the seat pad 16 to conform to the buttocks of the cyclist when in a riding position.

The lower pelvic covering region 44 of seat pad 16 includes a plurality of transverse arcuate break lines 46 disposed within a V-shaped break line 48 in the anterior region of the pad 16. A further transverse arcuate break line 50 is disposed at the point of V-shaped break line 48, curves in a converse direction from transverse arcuate break lines 46, and extends across the entire width of seat pad 16. Longitudinal break lines 28 extend forward to the lower pelvic covering region 44 and terminate adjacent V-shaped break line 48. The transverse arcuate break lines and the V-shaped break line provide an arching affect to seat pad 16 in order to more effectively wrap the pad from front to back around the lower pelvic region of the cyclist.

In summary, the seat pad 16 of the present invention has specifically positioned embossed lines in order to provide a comfortable, anatomically conforming fit. Longitudinal break lines 28 extend through the perineal covering region 30 in order to create a tunnelling effect which assists in fitting the seat pad between the legs of the cyclist. Generally transverse arcuate break lines 46 extend across the lower pelvic covering regions 44 in order to more effectively wrap the seat pad from front to back around the lower pelvic region of the cyclist. Further, oblique curving break lines are provided in the buttocks covering region 30 in order to bend and thereby anatomically conform the seat pad to the buttocks of the cyclist. Thus, the embossed break lines directly dictate the anatomical shape to which seat pad 16 must conform when attached to cycling shorts 10 and disposed adjacent the posterior of the cyclist and the embossed break lines therefore also conform to the anatomical shape of the cyclist as he moves into various positions.

It will be obvious to one of ordinary skill in the art that numerous modifications may be made without departing from the true spirit and scope of the present invention, which is to be limited only by the appended claims.

What is claimed is:

1. Cycling pants comprising:

a body portion having a waist opening and two leg openings such that a wearer can insert a leg through each said leg opening and pull said body portion upwards into a wearing position;

a pants liner covering the buttocks region, the perineal region, and extending upwards to the lower front pelvic region of the wearer when said body portion is positioned in the wearing position;

attaching means for attaching said liner to a surface of said body portion facing inwardly towards the wearer; and said liner including a plurality of integrally formed embossed break lines creating seamless indentations in said liner such that said liner conforms to the anatomical curves of the wearer when positioned in a riding position on a bicycle and thereby reduces abrasion to the wearer.

2. The cycling pants of claim 1 wherein said attaching means comprises stitching said liner to said body portion.

3. The cycling pants of claim 1 wherein said attaching means comprises laminating said liner to said body portion.

4. The cycling pants of claim 1 wherein said plurality of embossed break lines include generally longitudinally disposed break lines extending through the perineal covering region of said pants liner such that said liner bends along said longitudinal break lines to better fit between the legs of the wearer.

5. The cycling pants of claim 4 wherein at least one of said longitudinally disposed break lines extends rearward from the perineal covering region of said pants liner to said buttocks covering region of said liner.

6. The cycling pants of claim 4 wherein said plurality of embossed break lines further include generally transverse arcuate break lines disposed in the lower pelvic covering region of said pants liner such that said liner bends along said transverse arcuate break lines to more effectively wrap said liner around the lower pelvic region of the wearer.

7. The cycling pants of claim 6 wherein said plurality of embossed break lines further include generally oblique break lines disposed along the buttocks covering regions of said pants liner such that said liner anatomically conforms to the wearer.

8. The cycling pants of claim 7 wherein at least one of said oblique break lines intersects at least one of said longitudinal break lines.

9. The cycling pants of claim 1 wherein said pants liner comprises a backing layer attached to said body portion by said attaching means, a foam layer overlying said backing layer, and a covering layer disposed over said foam layer and facing inwardly towards the wearer.

10. The cycling pants of claim 9 wherein said foam layer comprises a pad of high density polyurethane foam.

11. The cycling pants of claim 9 wherein said covering layer comprises a piece of synthetic suede material having a soft napped side and a smooth side, said soft napped side of said covering layer being disposed adjacent the wearer.

12. The cycling pants of claim 9 wherein said plurality of embossed break lines form a plurality of depressed grooves in said covering layer and said foam layer.

13. The cycling pants of claim 12 wherein said plurality of depressed grooves include generally longitudinally disposed grooves extending through the perineal covering region of said pants liner such that said liner bends along said longitudinal break lines to better fit between the legs of the wearer.

14. The cycling pants of claim 13 wherein said plurality of depressed grooves further include generally transverse arcuate grooves disposed in the lower pelvic covering region of said pants liner such that said liner bends along said transverse arcuate grooves to more effectively wrap said liner around the lower pelvic region of the wearer.

15. The cycling pants of claim 14 wherein said plurality of depressed grooves further include generally oblique grooves disposed along the buttocks covering regions of said pants liner such that said liner anatomically conforms to the wearer.

16. The cycling pants of claim 1 wherein said body portion comprises a seven panel construction.

17. A liner for a pair of cycling shorts, said liner comprising:

a backing layer having an inner surface and an outer surface, said backing layer being configured to generally cover the buttocks, perineal and lower pelvic regions of a cyclist;

a foam layer corresponding to the shape of said backing layer and attached to the inner surface of said backing layer;

a covering layer overlying said foam pad and joining with a peripheral edge of said backing layer, said covering layer facing the body of the cyclist;

a plurality of integrally formed embossed break lines disposed throughout said covering layer, said embossed lines forming a plurality of seamless, depressed grooves in said foam layer such that said liner curves along said grooves and thereby anatomically conforms to the body of the cyclist while in a cycling position and reduces abrasion to the cyclist.

18. The liner of claim 17 wherein said backing layer comprises a nylon piece of material attachable to the cycling shorts.

19. The liner of claim 18 wherein said foam layer comprises a pad of high density foam.

20. The liner of claim 19 wherein the high density foam is an open cell polyurethane foam.

21. The liner of claim 19 wherein the high density foam is a closed cell polyurethane foam.

22. The liner of claim 19 wherein said covering layer comprises a synthetic suede material.

23. The liner of claim 17 wherein said plurality of embossed break lines include generally longitudinally disposed break lines extending through the perineal covering region of said covering layer such that said foam layer bends along said longitudinal break lines to better fit between the legs of the wearer.

24. The liner of claim 23 wherein one of said longitudinally disposed break lines extends rearward from the perineal covering region of said covering layer to said buttocks covering region of said covering layer.

25. The liner of claim 23 wherein said plurality of embossed break lines further include generally transverse arcuate break lines disposed in the lower pelvic covering region of said pants covering layer such that said foam layer bends along said transverse arcuate break lines and more effectively wraps around the lower pelvic region of the cyclist.

26. The liner of claim 25 wherein said plurality of embossed break lines further include generally oblique break lines disposed along the buttocks covering region of said covering layer such that said foam layer anatomically conforms to the wearer.

27. The liner of claim 26 wherein at least one of said oblique break lines intersects at least one of said longitudinal break lines.

* * * * *